US005540953A

United States Patent [19]

Harrington

[11] Patent Number: 5,540,953

[45] Date of Patent: Jul. 30, 1996

[54] PROCESS OF PREPARING FABRIC COMPRISING HYDROPHOBIC POLYOLEFIN FIBERS

[75] Inventor: James H. Harrington, Gwinnett County, Ga.

[73] Assignee: Hercules Incorporated, Wilmington, Del.

[21] Appl. No.: 457,952

[22] Filed: Jun. 1, 1995

Related U.S. Application Data

[60] Division of Ser. No. 16,346, Feb. 11, 1993, which is a continuation-in-part of Ser. No. 835,895, Feb. 14, 1992, abandoned.

[51] Int. Cl.[6] ..... B05D 3/02

[52] U.S. Cl. ..... 427/393.5; 156/308.8; 427/401; 428/288; 428/290; 428/369; 428/375; 428/394

[58] Field of Search ..... 427/393.1, 393.5, 427/401; 156/308.8; 428/288, 290, 309, 375, 394

[56] References Cited

U.S. PATENT DOCUMENTS

| | | | |
|---|---|---|---|
| 3,169,899 | 2/1965 | Steuber | 161/72 |
| 3,377,181 | 4/1968 | Kamijo et al. | 117/4 |
| 3,821,021 | 6/1974 | McMillin | 117/135.5 |
| 3,919,097 | 11/1975 | Park | 252/48.6 |
| 3,983,272 | 9/1976 | Huber et al. | 252/8.6 X |
| 4,058,489 | 11/1977 | Hellsten | 252/8.8 |
| 4,069,159 | 1/1978 | Hayek | 252/8.8 |
| 4,069,160 | 1/1978 | Hawkins | 252/8.8 |
| 4,072,617 | 2/1978 | Jahn | 252/8.8 |
| 4,082,887 | 4/1978 | Coates | 428/289 |
| 4,105,567 | 8/1978 | Koemer et al. | 252/8.9 |
| 4,105,569 | 8/1978 | Crossfield | 252/8.9 |
| 4,137,181 | 1/1979 | Hawkins | 252/8.9 |
| 4,179,543 | 12/1979 | Hawkins | 252/8.6 |
| 4,283,292 | 8/1981 | Marshall et al. | 252/8.8 |
| 4,291,093 | 9/1981 | Wishman et al. | 428/379 |
| 4,294,883 | 10/1981 | Hawkins | 252/8.6 |
| 4,423,092 | 12/1983 | Huhr et al. | 427/316 |
| 4,511,489 | 4/1985 | Reguejo et al. | 252/172 |
| 4,624,793 | 11/1986 | Phifer et al. | 252/8.6 |
| 4,717,507 | 1/1988 | Schwadtke et al. | 252/8.8 |
| 4,816,336 | 3/1989 | Alou, Jr. et al. | 428/361 |
| 4,816,356 | 3/1989 | Allou, Jr. et al. | 428/361 |
| 4,837,078 | 6/1989 | Harrington | 428/284 |
| 4,938,832 | 9/1990 | Schmalz | 427/393.1 X |
| 4,965,301 | 10/1990 | Leininger | 524/101 |
| 4,995,884 | 2/1991 | Ross et al. | 8/115.6 |
| 5,033,172 | 7/1991 | Harrington | 28/107 |
| 5,045,387 | 9/1991 | Schmalz | 428/284 |
| 5,232,742 | 8/1993 | Chakravarti | 427/387 |
| 5,368,913 | 11/1994 | Ortega | 156/290 X |
| 5,382,372 | 1/1995 | Eicken et al. | 252/8.6 |
| 5,403,426 | 4/1995 | Johnson et al. | 427/393.1 X |

FOREIGN PATENT DOCUMENTS

| | | |
|---|---|---|
| 0010764 | 5/1980 | European Pat. Off. . |
| 400622 | 12/1990 | European Pat. Off. . |
| 486158 | 10/1991 | European Pat. Off. . |
| 2351152 | 5/1977 | France . |
| 1494751 | 7/1964 | Germany . |
| 57-002828 | 1/1982 | Japan . |
| 62-047989 | 10/1987 | Japan . |
| 62-052072 | 11/1987 | Japan . |
| 828735 | 2/1960 | United Kingdom . |
| 999199 | 12/1963 | United Kingdom . |
| 1246134 | 9/1971 | United Kingdom . |
| 1533359 | 5/1976 | United Kingdom . |

OTHER PUBLICATIONS

Danaklon a/s, Hydrophobic Fibres, "Danaklon®HY-Dry Fibers: Why compromise on Processability?" May 6,1993.

Danaklon, "Danaklon SOFT 71 a unique combination of softness and strength for the nonwoven industry", No date.

Danaklon A/S, "The Valueadder of the Fiberworld", No date.

C. J. Wust, Jr., et al, "Fibers (Olefin) ", 10 *Kirk-Othmer Encyclopedia of Chemical Technology* 639–661 (4th Ed. 1994).

Danaklon A/S "Danaklon Hygienic Fibers for the Nonwoven Industry ", No date.

*Primary Examiner*—Michael Lusignan
*Attorney, Agent, or Firm*—Mark D. Kuller

[57] ABSTRACT

A fiber comprising a polyolefin fiber having a finish which comprises an antistatic composition, wherein the fiber with the finish has a hydrostatic head value at least about 102 mm and is capable of being processed into a nonwoven fabric on processing equipment comprising at least one card and means for bonding the fabric at a throughput of at least about 128 pounds/hours for a period of at least two hours without formation of significant solid antistatic composition build-up on the nonwoven fabric processing equipment, and related compositions and processes, and articles made with such fibers.

83 Claims, No Drawings

PROCESS OF PREPARING FABRIC COMPRISING HYDROPHOBIC POLYOLEFIN FIBERS

This is a divisional of U.S. patent application Ser. No. 08/016,346, filed Feb. 11, 1993, which is a continuation-in-part of U.S. patent application Ser. No. 07/835,895, filed Feb. 14, 1992, now abandoned, both of which are incorporated herein in their entirety by reference.

FIELD OF THE INVENTION

This invention relates to synthetic fibers, and manufacture and use thereof. It also relates to finish compositions for synthetic fibers.

BACKGROUND OF THE INVENTION

Polyolefin fibers may be processed into many different articles, such as fabrics. Nonwoven fabrics made from staple fibers are useful in articles such as diapers, sanitary napkins, tampons, underpants, and the like. In some applications, such as diaper leg cuffs and waist bands, these fabrics are used to manage flow of liquids and it is desirable that the fibers be hydrophobic.

Polyolefin fibers and, in particular, polypropylene fibers, are naturally hydrophobic. Generally, when finishes containing antistatic compositions (also called antistats) and/or lubricants are applied to the fiber surface in order to spin, process and form the articles from fibers, the fibers are rendered hydrophilic in nature.

Schmalz, in U.S. Pat. No. 4,938,832 and European Patent Application No. 486,158 which are incorporated herein in their entirety by reference, teach fiber with finish compositions comprising at least one neutralized phosphoric acid ester having a lower alkyl group, such as a 1–8 carbon alkyl group, which functions as an antistat, in combination with a silicone lubricant. These fibers have excellent properties, particularly for manufacture of hydrophobic nonwoven fabrics for diapers. However, these antistats have been observed to quickly form solid deposits on cards and calender rolls when the fibers are formed into fabrics. That is, a white build-up of material visible to the naked eye forms on cards and calenders in less than two hours. This may require an operator to increase bonding temperature, slow down a line or clean equipment on a frequent basis.

SUMMARY OF THE INVENTION

According to this invention, a fiber is provided comprising a polyolefin fiber having a finish which comprises an antistatic composition, wherein the fiber with the finish has a hydrostatic head value at least about 102 mm and is capable of being processed into a nonwoven fabric on processing equipment comprising at least one card and means for bonding the fabric at a throughput of at least about 128 pounds/hour for a period of at least two hours without formation of significant solid antistatic composition build-up on the nonwoven fabric processing equipment. The hydrostatic head value is preferably at least about 125 mm, more preferably at least about 150 mm, even more preferably at least about 181 mm, and even more preferably at least about 195 mm. The throughput is preferably at least about 179 pounds/hour, more preferably at least about 1,000 pounds/hour, and most preferably at least about 1,500 pounds/hour. The fiber is preferably about 0.1 to 40 dpf fiber, more preferably about 1 to 6 dpf fiber, and most preferably about 1.8 to 3 dpf fiber.

Preferably, the means for bonding the fabric is selected from the group consisting of calender roll, hot air, sonic or laser bonding. More preferably, the means for bonding the fabric comprises thermal bonding using a calender roll and no solid antistatic composition build-up visible to the naked eye forms on the calender roll.

Preferably, the fiber is capable of limiting electrostatic charge of less than about 4000 volts during processing; more preferably less than about 2000 volts, even more preferably less than about 1000 volts and most preferably less than about 500 volts.

Preferably, the fiber is capable of forming a nonwoven fabric having a basis weight of about 10–60 grams/square yard that has a cross directional strength of at least about 150 grams/inch by carding and thermally bonding using a calender roll with a thermal bond area of at least about 10%. More preferably, the fiber is capable of forming a nonwoven fabric having a basis weight of about 10–30 grams/square yard that has a cross directional strength of at least about 250 grams/inch by carding and thermally bonding using a calender roll with a thermal bond area of about 15–40%. Even more preferably, the fiber is capable of forming a nonwoven fabric having a basis weight of about 15–25, preferably about 19–20, grams/square yard that has a cross directional strength of at least about 350 grams/inch by carding and thermally bonding using a calender roll with a thermal bond area of about 15–20%.

The period is preferably at least about six hours and most preferably at least about one week.

The polyolefin fiber preferably comprises polypropylene. In one preferred embodiment, it comprises polypropylene homopolymer. In another preferred embodiment it comprises at least 90 weight % polypropylene and up to 10 weight % ethylene, butene or mixtures thereof. In yet another preferred embodiment, the fiber comprises a bicomponent fiber. Preferably, the bicomponent fiber comprises a polypropylene core layer and a polyethylene outer layer. Such fibers are preferably selected from the group consisting of a monofilament fiber, multifilament fiber and yarn.

Preferably, the fiber has a sink time of at least about 0.8 hour and the nonwoven fabric has a percent runoff value at least about 79%. More preferably, the fiber has a sink time of at least about 4 hours and the nonwoven fabric has a percent runoff value at least about 85%. Most preferably, the fiber has a sink time of at least about 20 hours and the nonwoven fabric has a percent runoff value at least about 94.5%.

Preferably, the fiber is a staple fiber having a length of about 1 to 6 inches, more preferably about 1 to 3 inches, and most preferably about 1¼ to 2 inches.

Preferably, the fiber is formed by spinning, drawing, crimping and cutting.

Preferably, the fiber further comprises a lubricant. Preferably, the lubricant is selected from the group consisting of mineral oils, paraffinic waxes, polyglycols and silicones. Most preferably, the lubricant comprises a polydimethylsiloxane.

The fiber comprises preferably about 0.1 to 1%, more preferably about 0.15 to 0.5%, and most preferably 0.15 to 0.3%, by dry weight of the fiber, of the finish.

In a preferred embodiment, the polyolefin fiber comprises about 1 to 6 dpf polypropylene fiber comprising about 0.1 to 1%, by dry weight of the fiber, of the finish and about 1 to 3 inch staple fibers made from the fiber having the finish are capable of forming a nonwoven fabric having a basis weight of about 10–30 grams/square yard that has a cross directional strength of at least about 250 grams/inch by carding and thermally bonding using a calender roll with a thermal bond area of about 15–40% with no solid antistatic composition build-up visible to the naked eye forming on the calender roll. Preferably, the finish further comprises a lubricant. Preferably, the fiber is capable of limiting electrostatic charge of less than about 4000 volts during processing.

In a more preferred embodiment, the polyolefin fiber comprises about 1.8 to 3 dpf polypropylene fiber comprising about 0.1 to 1%, by dry weight of the fiber, of the finish and the finish further comprises a lubricant and about 1 to 3 inch staple fibers made from the fiber having the finish are capable of forming a nonwoven fabric having a basis weight of about 15–25 grams/square yard that has a cross directional strength of at least about 350 grams/inch by carding and thermally bonding using a calender roll with a thermal bond area of about 15–20% wherein the throughput is at least about 1,000 pounds/hour and the processing is carried out for at least about six hours with no solid antistatic composition build-up visible to the naked eye forming on the calender roll.

In an even more preferred embodiment, the polyolefin fiber comprises 1.8 to 3 dpf polypropylene fiber comprising about 0.15 to 0.3%, by dry weight of the fiber, of the finish and the finish further comprises a lubricant, and about 1¼ to 2 inches inch staple fibers made from the fiber having the finish are capable of forming a nonwoven fabric having a basis weight of about 19 to 20 grams/square yard that has a cross directional strength of at least about 350 grams/inch by carding and thermally bonding using a calender roll with a thermal bond area of about 15–20% wherein the throughput is at least about 1,000 pounds/hour and the processing is carried out for at least about one week with no solid antistatic composition build-up visible to the naked eye forming on the calender roll and wherein the fiber is capable of limiting electrostatic charge to less than about 2000 volts during processing, the fiber having the finish has a sink time of at least about 4 hours and the nonwoven fabric has a percent runoff value at least about 79%.

Preferably, the finish comprises an antistatic composition selected from the group consisting of composition (I) which comprises:

(a) at least one neutralized $C_3$–$C_{12}$ alkyl or alkenyl phosphate alkali metal or alkali earth metal salt; and (b) a solubilizer comprising at least one member selected from the group consisting of glycols, polyglycols, glycol ethers, and neutralized phosphoric ester salts having the general formula:

$$(MO)_x-\overset{\overset{\displaystyle O}{\|}}{P}\leftarrow O(R_1)_nR)_y \qquad (2)$$

wherein M, which may be the same or different, is an alkali or alkali earth metal or hydrogen, R is a $C_{16}$–$C_{22}$ alkyl or alkenyl group, $R_1$ is ethylene oxide or propylene oxide, and n is 1 to 10, x is 1 to 2 and y is 2 to 1, and x+y=3, and composition (II) which comprises at least one neutralized phosphoric ester salt having the general formula (2). Preferably, the finish comprises 20:1 to 0.5:1 by weight of the antistat composition to the solubilizer. More preferably, the finish further comprises a lubricant and the ratio of antistatic composition to the lubricant is about 5:1 to 1:5 by weight.

Preferably, the neutralized phosphate salt (the antistat) has a pH of about 5 to 9, more preferably about 5 to 7.

Also according to this invention is provided a fiber comprising a polyolefin fiber having a finish which comprises an antistatic composition, wherein the fiber with the finish has a hydrostatic head value at least about 102 mm and is capable of being processed into a nonwoven fabric on processing equipment comprising at least one card and means for bonding the fabric at a speed of at 250 feet/minute for a period of at least two hours without formation of significant solid antistatic composition build-up on the nonwoven fabric processing equipment. Preferably, the processing equipment comprises a card and thermal bonding on a calender roll and no solid antistatic composition roll deposits are visible to the naked eye on the calender roll after at least 2 hours of processing, more preferably at least 6 hours of processing, and most preferably at least one week.

Also according to this invention is provided a fiber comprising a polyolefin fiber having a finish comprising an antistatic composition which comprises: (a) at least one neutralized $C_3$–$C_{12}$ alkyl or alkenyl phosphate alkali metal or alkali earth metal salt; and (b) a solubilizer, wherein the fiber having the finish is hydrophobic. Preferably, the alkyl or alkenyl group is a $C_6$–$C_{12}$ alkyl group. More preferably, the alkyl or alkenyl group is a $C_8$–$C_{12}$ alkyl group. Preferably, the neutralized alkyl phosphate salt is an alkali metal salt. Most preferably, the neutralized alkyl phosphate salt is an alkali metal salt selected from the group consisting of sodium and potassium salts, most preferably a potassium salt. Preferably, the fiber comprises about 0.1 to 1%, by dry weight of the fiber, of the finish and the fiber having the finish has a hydrostatic head value at least about 30 mm. More preferably, the fiber comprises polypropylene and the fiber having the finish has a hydrostatic head value at least about 62 mm.

Preferably, the neutralized phosphate salt (the antistat) has a pH of about 5 to 9, more preferably about 5 to 7.

Preferably, the solubilizer comprises at least one member selected from the group consisting of glycols, polyglycols, glycol ethers, and neutralized phosphoric ester salts having the general formula (2). In a preferred embodiment, the solubilizer comprises at least one compound selected from the group consisting of glycols and polyglycols, most preferably diethylene glycol or polyethylene glycol. In another preferred embodiment, the solubilizer comprises the neutralized phosphoric ester salt.

Preferably, the solubilizer comprises at least one member selected from the group consisting of glycols, polyglycols, and potassium or sodium oleyl (EO) phosphate having an ethylene content range of 2 to 9 moles.

Preferably, the fiber is a staple fiber having a length of about 1 to 6 inches. Preferably, the fiber comprises polypropylene. More preferably, the fiber is 1 to 6 dpf fiber cut into a stable fiber having a length of about 1 to 3 inches. Preferably, the fiber is capable of forming a nonwoven fabric having a basis weight of about 15–25 grams/square yard that has a cross directional strength of at least about 250 grams/inch by carding and thermally bonding using a calender roll with a thermal bond area of about 15–40%. Preferably, the finish comprises a lubricant which is preferably at least one member selected from the group consisting of mineral oils, paraffinic waxes, polyglycols and silicones.

Also according to the invention, a fiber is provided comprising a polyolefin fiber having an antistatic finish which comprises at least one neutralized phosphoric ester salt having the general formula (2). Preferably, the neutralized phosphoric ester salt is an alkali metal salt of oleyl ethylene oxide phosphate and n is 2–9. More preferably, the neutralized phosphoric ester salt is a sodium oleyl (EO) phosphate having an ethylene content range of 2 to 9 moles. Preferably, the fiber further comprises a lubricant. The fiber preferably comprises polypropylene. More preferably, the fiber is 1 to 6 dpf fiber comprising 0.1 to 1%, based on the dry weight of the fiber, of finish and the fiber having the finish has a hydrostatic head value at least about 62 mm, is cut into staple fiber having a length of about 1–3 inches, and is capable of forming a nonwoven fabric having a basis weight of about 10–60 grams/square yard that has a cross directional strength of at least about 150 grams/inch by carding and thermally bonding using a calender roll with a thermal bond area of at least about 10%. Preferably, the fiber comprises about 0.1 to 5%, by dry weight of the fiber, of finish. Preferably, in this embodiment, the compound of the formula (2) has a pH of about 5 to 9, more preferably 5 to 7.

Also according to the invention is provided a fabric comprising a fiber as described above. Preferably, the fabric is a nonwoven, the fibers are staple fibers having a length of about 1 to 3 inches made from 1 to 6 dpf fiber. Preferably, the fabric prepared by carding and thermal bonding. Preferably, the fibers comprise 0.1 to 1%, by dry weight of the fiber, finish and the fabric has a percent runoff value at least about 79%. More preferably, the fabric has a percent runoff value at least about 85%, most preferably at least about 94.5%. Preferably, the fabric comprises polypropylene fibers.

Preferably, the fabric is nonwoven fabric having a basis weight of about 10 to 60 grams/square yard and a cross directional strength of at least about 150 grams/inch which is prepared by carding and thermally bonding using a calender roll with a thermal bond area of at least about 10%. More preferably, the fabric has a basis weight of about 10–30 grams/square yard and a cross directional strength of at least about 250 grams/inch, prepared by carding and thermally bonding using a calender roll with a thermal bond area of about 15–40%, wherein the fibers comprise polypropylene fibers. Even more preferably, the fabric has a basis weight of about 15–25 grams/square yard and a cross directional strength of at least about 350 grams/inch, prepared by carding and thermally bonding using a calender roll with a thermal bond area of about 15–20. Most preferably, the basis weight is about 19–20 grams/square yard. Preferably, the fabric has a percent runoff value at least about 85%. More preferably, the fabric has a percent runoff value at least about 94.5%. Preferably, the finish further comprises a lubricant.

Also according to this invention is provided an article comprising a fluid-absorbent material and the fabric.

Also according to this invention is provided a diaper comprising a water impermeable backing layer and nonwoven fabric with an absorbent material arranged between the impermeable backing layer and nonwoven fabric, further comprising at least one member selected from the group consisting of leg cuffs and a waist band, wherein the member comprises the nonwoven fabric.

Also according to this invention is provided a diaper comprising a water impermeable backing layer and nonwoven fabric with an absorbent material arranged between the impermeable backing layer and nonwoven fabric, further comprising at least one member selected from the group consisting of leg cuffs and a waist band, wherein the member comprises a nonwoven fabric as described above wherein the fiber comprises an antistatic composition selected from the group consisting of composition (I) which comprises: (a) at least one neutralized $C_3$–$C_{12}$ alkyl or alkenyl phosphate alkali metal or alkali earth metal salt; and (b) a solubilizer, and composition (II) which comprises at least one neutralized phosphoric ester salt having the general formula (2).

Also according to this invention is provided a process of producing a fiber comprising forming a polyolefin fiber and applying a finish comprising an antistatic composition to the polyolefin fiber to obtain a fiber having a hydrophobic head value at least about 102 mm and which is capable of being processed into a nonwoven fabric on processing equipment comprising at least one card and means for bonding the fabric at a throughput of at least about 128 pounds/hours for a period of at least two hours without formation of significant solid antistatic composition build-up on the nonwoven fabric processing equipment.

Also according to this invention is provided a process of producing a fiber comprising forming a polyolefin fiber and applying a finish comprising an antistatic composition to the polyolefin fiber, wherein the finish comprises an antistatic composition selected from the group consisting of composition (I) which comprises: (a) as an antistat, at least one neutralized $C_3$–$C_{12}$ alkyl or alkenyl phosphate alkali metal or alkali earth metal salt; and (b) a solubilizer, and composition (II) which comprises at least one neutralized phosphoric ester salt having the general formula (2). Preferably, the finish is applied as a over finish after crimping and before cutting the fibers. Preferably, the over finish is an aqueous solution which comprises 2 to 60 weight % of the antistatic composition (I). The over finish preferably comprises 10:1 to 1:1 by weight of the antistat to the solubilizer.

In one preferred embodiment, the over finish preferably comprises a lubricant. Preferably, the ratio of antistatic composition:lubricant is about 1:5 to 5:1 by weight.

In another preferred embodiment, the finish is applied as a spin finish. Preferably, the spin finish is an aqueous solution which comprises 0.5 to 60%, by weight, of the composition (I). Preferably, the spin finish comprises 20:1 to 1.5:1 by weight of the antistat to the solubilizer. Preferably, the spin finish further comprises a lubricant. More preferably, the spin finish further comprises a lubricant and the ratio of antistatic composition:lubricant is about 1:5 to 5:1 by weight. More preferably, the spin finish is an aqueous solution which comprises 0.5 to 30%, by weight, of the antistatic composition. More preferably, the spin finish comprises 10:1 to 2:1 by weight of the antistat to the solubilizer. More preferably, the spin finish further comprises a lubricant and the ratio of antistatic composition:lubricant is about 1:2 by weight. Even more preferably, the spin finish is an aqueous solution which comprises 0.5 to 5%, by weight, of the antistatic composition, and preferably comprises lubricant.

In another preferred embodiment, the over finish is an aqueous solution which comprises about 0.5 to 60% of the compound of formula (2). Preferably, the over finish is an aqueous solution which comprises about 4 to 25% of the compound of formula (2).

In another preferred embodiment, the spin finish is an aqueous finish comprising about 0.1–10 weight % of the compound of formula (2). Preferably, the spin finish is an aqueous finish comprising about 0.5–5 weight % of the compound of formula (2). More preferably, the spin finish further comprises lubricant.

Also according to this invention, an antistatic composition is provided for treating fibers comprising: (a) a neutralized $C_3$–$C_{12}$ alkyl or alkenyl phosphate alkali metal or alkali earth metal salt; and (b) a solubilizer. Preferably, the solubilizer is selected from the group consisting of glycols, polyglycols, glycol ethers, and a neutralized phosphoric ester salts having the general formula (2), with glycols, polyglycols and the compounds of the general formula (2) being preferred. Preferably, the ratio of the neutralized phosphate salt (a) to the solubilizer (b) is in the range of 20:1 to 0.5:1 by weight. In one preferred embodiment, the composition comprises a lubricant. Preferably, the ratio of antistatic composition to lubricant is 1:5 to 5:1 by weight.

Also according to this invention is provided a process of producing an antistatic composition for treating fibers comprising mixing (a) a neutralized $C_3$–$C_{12}$ alkyl or alkenyl phosphate alkali metal or alkali earth metal salt; and (b) a solubilizer.

Also according to this invention is provided a composition comprising (a) an antistatic composition which comprises at least one neutralized phosphoric ester salt having the general formula (2) and (b) a lubricant. Preferably, the lubricant is selected from the group consisting of mineral oils, paraffinic waxes, polyglycols and silicones.

Also according to the invention, a non-depositing antistatic composition is provided for treating fibers comprising:

(A) an antistat selected from the group consisting of alkali metal $C_6$ to $C_{12}$ alkyl phosphates; and (B) a solubilizer. Preferably, the solubilizer is selected from the group consisting of glycols, polyglycols, glycol ethers, and potassium or sodium oleyl (EO) phosphate with an ethylene oxide content range of 2 to 9 moles. Preferably, said alkali metal is sodium or potassium, most preferably potassium. Preferably, the antistat is potassium $C_8/C_{10}$ alkyl phosphate.

Preferably, the solubilizer is selected from the group consisting of diethylene glycol, polyethylene glycol, and sodium oleyl (EO)9 phosphate. Preferably, the solubilizer is used in an amount of from 5 to 50% of the antistat.

Also according to the invention is provided a non-depositing antistatic composition for treating fibers as described above, further comprising a silicone lubricant. Preferably, the silicone lubricant is polydimethylsiloxane.

In all of these, the polyolefin is preferably polypropylene.

Also according to this invention is provided a non-depositing, hydrophobic, polyolefin fiber which comprises a polyolefin fiber treated with an antistatic composition comprising:

(A) an antistat selected from the group consisting of alkali metal $C_8$ to $C_{12}$ alkyl phosphates and sodium oleyl (EO) phosphate; and (B) a solubilizer selected from the group consisting of glycols, polyglycols, glycol ethers, and potassium or sodium oleyl (EO) phosphate with an ethylene oxide content range of 2 to 9 moles, provided that when the antistatic is sodium oleyl (EO) phosphate, the solubilizer may be omitted. Preferably, the alkali metal is sodium or potassium. More preferably, the alkali metal is potassium.

The polyolefin is preferably polypropylene.

Preferably, the antistat is potassium $C_8/C_{10}$ alkyl phosphate.

Preferably, the solubilizer is selected from the group consisting of diethylene glycol, polyethylene glycol, and sodium oleyl (EO)9 phosphate. Preferably, the solubilizer is used in an amount of from 5 to 50% of the antistat.

Also according to the invention is provided a non-depositing antistatic composition for treating fibers as described above, further comprising a silicone lubricant. Preferably, the lubricant comprises a polydimethylsiloxane.

Preferably, the fiber is treated with from about 0.05% to about 0.30% of said antistat based on the weight of the fiber.

Also according to the invention, a fabric is produced from a fiber as described above. Preferably, the fabric is characterized by percent runoffs greater than 90% and cross directional strengths of greater than or equal to 500 grams/inch.

DETAILED DESCRIPTION OF THE INVENTION

It should be understood that the properties of the fibers described herein are those of the fiber with the finish on it, unless otherwise indicated.

"Non-depositing" is used herein to describe a condition where there is no significant solid antistat composition build-up on processing equipment. By "significant" solid antistat composition build-up it is meant that no solid material build-up can be seen by the naked eye on processing equipment substantially every time the antistatic composition is used on a polyolefin fiber as a finish in sufficient quantity so that the fiber is hydrophobic and when the fiber is processed into a nonwoven fabric on processing equipment comprising at least one card and means for bonding the fabric at a throughput of at least about 128 pounds/hour for a period of at least two hours. (While reference is made to fiber in the form of filament, yarn or staple, it is well known that the fiber must be in staple form for the card and bond process.)

The build-up referred to above is seen as a white solid on the card or calender rolls, or on associated equipment such as a collection plate. (In some instances, it is necessary to remove cover plates and the like to observe the deposit with the naked eye. For instance, cards often have elements that do not permit viewing of internal operating surfaces and elements upon which deposits occur that are not observable unless the cards are disassembled.) Processing equipment having this build up must be cleaned of the solid antistat composition prior to additional fabric production. With this invention such a build up is not found to occur after at least two hours, preferably after at least about six hours and most preferably after at least about one week, of processing. Preferably, such a build-up does not occur for such time periods at throughputs of at least about 179 pounds/hour, more preferably at least about 1,000 pounds/hour, and most preferably at least about 1,500 pounds/hour.

As used herein, the term "fiber" is used with respect to what are often called fibers or filaments. The fiber may be in continuous lengths or in staple form. Continuous fiber is often referred to as filament, monofilament fiber, multifilament fiber or yarn. Multifilament fiber or yarn may be in what is known as tow or staple form, and may be crimped or not. Nonwoven fabrics are made on card and bond equipment using staple fiber. Preferably, staple fibers are about 1 to 6 inches long. Preferably, staple fiber used in nonwoven fabric for diapers have lengths of about 1 to 3 inches, more preferably about 1¼ to 2 inches.

The fibers of this invention are preferably polyolefins made from $C_2$–$C_6$ monomers, preferably from $C_2$–$C_4$ monomers. Of these, preferred are propylene and ethylene polymers. Most preferred are polypropylene fibers, which may be homopolymers, or copolymers which preferably have up to 10 weight %, based on the weight of the polymer, of ethylene, butene or mixtures thereof. Typically, such fibers are obtained from conventional linear polypropylene or copolymers thereof with ethylene, 1-butene, 4-methylpentene- 1 and the like.

The fiber of the instant invention may be of any size that can be processed through means known in the art. Preferably the fiber of the instant invention is a fine denier polypropylene fiber in the form of a multifilament fiber or yarn within the range of about 0.1 to 40 denier per filament (dpf). Preferred for use in hydrophobic nonwoven fabrics useful as leg cuffs and waistbands of diapers are 1 to 6 dpf fibers, with 1.8 to 3 dpf fibers being most preferred. Herein, dpf is used according to its art recognized meaning as weight in grams per 9,000 meter length of filament.

Such fibers may be mono-, multi-component (e.g., bi-component) or biconstituent fibers. By bi-component fiber, reference is made to, for example, fibers with a polypropylene core layer and polyethylene outer layer. However, other multi-component fibers may be of utility in the instant invention, provided a polyolefin layer is on the outside or periphery such as, polyethylene/polyester bi-component fibers, for example. Other types of bi-component or bi-constituent fibers known in the art include fibers with a side by side arrangement and fibers with a matrix/fibril arrangement.

Fibers of the instant invention may also contain additives which are known in the art including calcium stearate, antioxidants, degrading agents, pigments, including whiteners and colorants such as $TiO_2$ and the like. Fibers of the instant invention may also preferably include biocides or antimicrobials. Generally such additives can individually vary in amount, from about 0.1% to 3% by weight of spin melt.

While the invention is useful with most polyolefin fibers, the preferred fibers and manufacturing techniques for use in this invention are described by Kozulla in U.S. patent application Ser. Nos. 07/474,897, 07/683,635 (now U.S. Pat. No. 5,318,735), application Ser. No. 07/836,438, 07/887,416 (now U.S. Pat. No. 5,281,378) and application Ser. No. 07/939,857 (now U.S. Pat. No. 5,431,994) and European Patent Application No. 445,536, by Gupta et al. in U.S. patent application Ser. Nos. 07/818,772 and 07/943,190, by Schmalz in U.S. Pat. No. 4,938,832, U.S. patent application Ser. Nos. 07/614,650 and 07/914,213, and European Patent Application No. 486,158, and by Johnson et al in U.S. patent application Ser. Nos. 07/706,450 and 07/973,583 (now U.S. Pat. No. 5,403,426), and European Patent Application No. 516,412, all of which are incorporated herein in their entirety by reference.

A preferred antistatic composition comprises: (a) at least one neutralized $C_3$–$C_{12}$ alkyl or alkenyl phosphate alkali metal or alkali earth metal salt; and (b) a solubilizer.

Preferred as the neutralized $C_3$–$C_{12}$ alkyl or alkenyl phosphate salt are the alkali metal salts, with sodium and potassium salts being more preferred and potassium salts being most preferred. Preferred neutralized alkyl or alkenyl phosphate salts have the general formula:

$$(MO)_x-\overset{\overset{\displaystyle O}{\|}}{P}\leftarrow OR)_y \qquad (1)$$

wherein M, which may be the same or different, is an alkali or alkali earth metal or hydrogen, R is a $C_3$–$C_{12}$ alkyl or alkenyl group, x is 1 to 2, y is 2 to 1, and x+y=3, wherein x is preferably 2. One preferred compound is neutralized potassium $C_8/C_{10}$ alkyl phosphate salt, which is a blend of an isooctyl and isodecyl neutralized potassium phosphate salt. Preferably, the neutralized phosphate salt has a pH of about 5 to 9, more preferably about 5 to 7.

The neutralized $C_6$ or higher alkyl and alkenyl phosphate salts are preferred since they readily dissolve in the solubilizer, with $C_8$ and higher being more preferred.

The lower alkyl and alkenyl salts, such as the $C_4$ alkyl salt, do not easily dissolve in the solubilizer. However, these salts can be dissolved with the higher alkyl salts, such as the neutralized $C_8/C_{10}$ alkyl phosphate salt. This is advantageous as better antistatic properties are obtained with compounds having shorter alkyl chains. As a result, less antistat is necessary and higher hydrophobicity is obtained with lower amounts of antistat. Accordingly, the most preferred embodiment comprises mixtures of lower alkyl or alkenyl (preferably $C_3$ and $C_4$ alkyl, preferably in amounts of up to 60 weight %) and higher alkyl or alkenyl (preferably $C_8$ to $C_{12}$) salts.

By a "solubilizer" reference is made to a composition in which an effective amount of the antistat (i.e., the neutralized alkyl or alkenyl phosphate alkali metal or alkali earth metal salt or mixtures thereof) is soluble or dissolves at room temperature or slightly elevated temperatures (preferably about room temperature to 80° C., more preferably about room temperature to 70° C.). Preferred as solubilizer are glycols, polyglycols, glycol ethers, and a neutralized phosphoric ester salts having the general formula:

$$(MO)_x-\overset{\overset{\displaystyle O}{\|}}{P}\leftarrow O(R_1)_nR)_y \qquad (2)$$

wherein M, which may be the same or different, is an alkali or alkali earth metal or hydrogen, R is a $C_{16}$–$C_{22}$ alkyl or alkenyl group, preferably an alkenyl group, $R_1$ is ethylene oxide or propylene oxide, and n is 1 to 10, x is 1 to 2 and y is 2 to 1, and x+y=3. Preferred are the glycols, polyglycols and neutralized phosphoric ester salts. More preferred are diethylene glycol (DEG), polyethylene glycol (PEG), or potassium or sodium oleyl (EO) phosphate. The most preferred are diethylene glycol, polyethylene glycol and sodium oleyl $(EO)_9$ phosphate. The preferred polyethylene glycols are PEG 200, PEG 300, and PEG 400.

It should be understood that n of formula (2) is referring to the average number of moles of ethylene or propylene oxide. For instance, when n is 9 and $R_1$ is ethylene oxide the compound is typically a mixture of adducts in which the ethylene oxide:alcohol weight ratio can range from about 1:1 to 20:1.

In the non-depositing antistatic composition, compound (a) is generally an antistatic agent and compound (b) is generally a solubilizer, but the neutralized phosphoric ester salts having the general formula (2) may act by themselves as antistatic agents and since they are liquids at room temperature or at slightly elevated temperatures no solubilizer is needed. Thus, another preferred finish comprises at least one neutralized phosphoric ester salt having the general formula (2). Preferably, the neutralized phosphate salt of formula (2) has a pH of about 5 to 9, more preferably about 5 to 7.

When used with the neutralized alkyl phosphate alkali metal or alkali earth metal salt or by itself, preferred are compounds of the formula (2) which are alkali metal salts wherein $R_1$ is ethylene oxide. Preferably, n is 2 to 9. Preferably, R contains one carbon-carbon double bond. Most preferred are potassium or sodium oleyl (EO) phosphate, preferably having an ethylene content range of 2 to 9 moles, most preferably about 9 moles.

The non-depositing antistat composition described above may optionally contain a lubricant. Lubricants may be used to control or adjust the friction of the fiber upon which it is applied. The antistat composition may be topically applied at the same point or different points during processing as the lubricant. When applied at the same point, the lubricant may be included in the non-depositing antistat composition prior to its topical application. Preferably, the antistat composition is not miscible in the lubricant.

Lubricants useful in the instant invention are selected so that the fibers are hydrophobic and, preferably, are selected from the group consisting of mineral oils, paraffinic waxes, polyglycols and silicones. Preferred are the mineral oils, paraffinic waxes and silicones. More preferred are the silicone lubricants, with the preferred siloxanes having the general formula:

$$X\left(\begin{array}{c}R_2\\|\\Si-O\\|\\R_2\end{array}\right)_m Y \quad (3)$$

wherein X is a hydrophobic chemical end group, preferably a lower alkyl group (most preferably $C_1$–$C_4$); $R_2$, which may be the same or different, are lower alkyl groups (preferably $C_1$–$C_{10}$, and most preferably a methyl group); and m is an integer within the range of about 10–50 or higher; and Y is —$SIR_3$ wherein $R_3$ is selected a lower alkyl group (preferably $C_1$–$C_4$ alkyl, and more preferably methyl), as described by Schmalz in U.S. Pat. No. 4,938,832, U.S. patent application Ser. Nos. 07/614,650 and 07/914,213, and European Patent Application No. 486,158, and by Johnson et al in U.S. patent application Ser. Nos. 07/706,450 and 07/973,583 (now U.S. Pat. No. 5,403,426), and European Patent Application No. 516,412, all of which are incorporated herein in their entirety by reference. The most preferred lubricant is polydimethylsiloxane.

Staple fibers may be prepared according to this invention by extrusion, spinning, drawing, crimping and cutting, such as the processes shown by Kozulla in U.S. patent application Ser. Nos. 07/474,897, 07/683,635 (now U.S. Pat. No. 5,318,735), application Ser. No. 07/836,438, 07/887,416 (now U.S. Pat. No. 5,281,378) and application Ser. No. 07/939,857 (now U.S. Pat. No. 5,431,994), and European Patent Application No. 445,536, by Gupta et al. in U.S. patent application Ser. Nos. 07/818,772 and 07/943,190, by Schmalz in U.S. Pat. No. 4,938,832, U.S. patent application Ser. Nos. 07/614,650 and 07/914,213, and European Patent Application No. 486,158, and by Johnson et al in U.S. patent application Ser. Nos. 07/706,450 and 07/973,583 (now U.S. Pat. No. 5,403,426), and European Patent Application No. 516,412, all of which are incorporated herein in their entirety by reference.

A preferred process for preparing the fibers includes extruding polypropylene granules into fine denier fiber using an ordinary spinnerette. A spin finish is applied to the fiber prior to winder take-up. A spin yarn in multifilament or tow form is drawn and crimped. An over finish is applied to the crimped tow. The crimped tow is cut into staple fiber.

The antistat composition of this invention is topically applied as a finish on the fiber surface. The finish is applied through methods known in the art which include passing the fiber over a feed or kiss roll partially immersed in a bath of the finish, spraying an effective amount on to the fiber surface or metering a stream of finish through an orifice in a slotted pin or guide so that as the fiber is passed through the slot or guide an amount of finish is topically applied to the fiber.

Finish may be applied at one or more points during fiber manufacture. A spin finish is primarily intended for passing the filaments through the fiber manufacturing equipment. The spin finish is topically applied, preferably by passing the fiber over a feed wheel or kiss roll partially immersed in a bath of the above-described non-depositing antistat composition, dipped therein. An overfinish is primarily intended for users of the fibers or filaments and, preferably, in the case of staple fiber manufacture is topically applied after crimping and prior to cutting the filaments into staple fibers.

The spin finish and over finish typically are solutions containing up to 100% of either antistatic composition or lubricant, and are generally applied as aqueous solutions or emulsions.

Preferably, finish containing the antistatic composition of this invention is applied as an over finish after crimping and before cutting the fibers. In the case of the antistatic composition which comprises (a) at least one neutralized $C_3$–$C_{12}$ alkyl or alkenyl phosphate alkali metal or alkali earth metal salt, and (b) a solubilizer, the over finish is an aqueous solution which comprises about 2 to 60 weight % of the antistatic composition. Preferably, the over finish comprises about 20:1 to 0.5:1, more preferably about 10:1 to 1:1, and most preferably 3:1 to 1:1 by weight of the antistat (neutralized phosphate salt) to the solubilizer. Such an over finish may further comprise a lubricant. In that embodiment, preferably the ratio of antistatic composition (antistat and solubilizer) to lubricant is about 1:5 to 5:1 by weight.

Alternatively, the over finish may contain up to 100% of the compound of formula (2). Preferably, this embodiment comprises an aqueous solution which comprises about 0.5 to 60%, preferably about 4 to 25%, of the compound of formula (2). Such an over finish may further comprise a lubricant. In that embodiment, preferably the ratio of antistatic composition (antistat and solubilizer) to lubricant is about 1:5 to 5:1 by weight.

The antistatic composition may also be applied as a spin finish. In the case of the antistatic composition which comprises (a) at least one neutralized $C_3$–$C_{12}$ alkyl or alkenyl phosphate alkali metal or alkali earth metal salt, and (b) a solubilizer, the spin finish is an aqueous solution which preferably comprises about 0.5 to 60%, more preferably about 0.5 to 30%, by weight, of the antistatic composition. The spin finish preferably comprises about 20:1 to 1.5:1, more preferably about 10:1 to 2:1, of the antistat (phosphate salt) to the solubilizer. The spin finish preferably comprises a lubricant. Preferably, the ratio of antistatic composition (antistat and solubilizer):lubricant is about 1:5 to 5:1. Preferably, the ratio of antistatic composition (antistat and solubilizer) to lubricant is about 1:2.

In the case where the spin finish comprises the compound of the formula (2), the spin finish is preferably an aqueous solution which comprises about 0.5 to 60%, more preferably about 0.1–10%, most preferably about 0.5–5 weight % by weight, of the antistatic composition. Preferably, the spin finish comprises lubricant. Preferably, the ratio of antistatic composition (antistat and solubilizer) to lubricant is about 1:5 to 5:1, most preferably about 1:2.

In a preferred embodiment, the finish is applied as an aqueous spin finish comprising lubricant and, optionally, the antistatic composition, and an aqueous over finish comprising the antistatic composition. Preferably, the spin finish is an aqueous solution containing 1.1 weight % antistat containing a neutralized $C_8/C_{10}$ alkyl phosphate salt and diethylene glycol in a weight ratio of 3:1 and 1.9 weight % polydimethylsiloxane and the over finish is an aqueous solution containing 53 weight % antistat (neutralized $C_8/C_{10}$ alkyl phosphate salt and diethylene glycol in a weight ratio of 3:1).

The fiber comprises preferably about 0.1 to 1%, more preferably about 0.15 to 0.5%, and most preferably about 0.15 to 0.3%, by dry weight of the fiber, of the finish.

Finishes are typically prepared by mixing the antistat or antistat/composition (containing solubilizer) with water and lubricant to get the desired concentration. (The antistat, solubilizer and lubricant are available in aqueous solutions or emulsions.) When the antistat is used with a solubilizer, the antistat is usually premixed with the solubilizer to solubilize (dissolve or emulsify) the antistat prior to mixing with lubricant or water.

The fiber upon which the non-depositing antistat composition has been applied may be processed through such steps as carding and bonding. Nonwoven fabrics according to the present invention are bonded through well known bonding techniques, such as use of calender rolls, hot air, sonic or laser bonding and the like. Needle punch techniques may also be used to form a fabric. In addition, the resulting nonwoven fabric can be embossed and/or calender printed, using conventional techniques, with various designs and colors, to increase loft, augment wet strength, and provide a means for identifying articles fabricated therefrom. The preferred process for preparing nonwoven fabrics according to this invention comprises carding with at least one card, depending on the desired basis weight, and thermal calender bonding.

Preferably, a nonwoven fabric according to this invention having a basis weight of about 10 to 60 grams/square yard has a cross directional strength of at least about 150 grams/inch when prepared by carding and thermally bonding using a calender roll with a thermal bond area of at least about 10%. More preferably, a nonwoven fabric having a basis weight of about 10 to 30 grams/square yard has a cross directional strength of at least about 250 grams/inch when prepared by carding and thermally bonding using a calender roll with a thermal bond area of about 15 to 40%. Even more preferably, a nonwoven fabric having a basis weight of about 15 to 25 grams/square yard has a cross directional strength of at least about 350 grams/inch when prepared by carding and thermally bonding using a calender roll with a thermal bond area of about 15 to 20%. Most preferably, for use in diapers, the basis weight is about 19 to 20 grams/square yard.

Polyolefin fibers build up electrostatic charges during processing. The polyolefin fibers having the finish of this invention maintains or limits electrostatic charge so that it is within an acceptable range for fiber processing. The fact that the charge level is acceptable is indicated by the fact that the staple fibers can be processed into nonwoven fabrics at the throughputs described above. Preferably, the fibers having the finish of this invention discharge electrical potential generated during processing (fiber movement across conducting (e.g., metal) surfaces). Preferably, the fiber having the finish of this invention limits electrostatic charge to less than or equal to about 4,000 volts, preferably less than or equal to about 2,000 volts, more preferably less than or equal to about 1000 volts, and most preferably about 500 or fewer volts during processing. Such steps include blending, carding and thermally bonding the fibers. It is preferred to run card and bond equipment at high humidity, in order to control static build-up.

Other hydrophobic antistatic finishes, such as those described by Schmalz in U.S. Pat. No. 4,938,832 and European Patent Application No. 486,158, leave a significant solid deposit on processing equipment, such as a calender roller or a card after two hours of fiber processing. The fibers having the finish of this invention are capable of being processed without leaving such solid deposits on processing equipment. Such processing equipment includes take-up devices, fiber openers, conveying duct work, cut fiber blenders, cards, means for bonding such as calender rolls, etc. Preferably, they are capable of being processed for at least two hours, more preferably at least about six hours, and most preferably at least about one week at the throughputs listed above on card and thermal bond calender rolls without leaving significant solid deposits on the face of the calender roll.

The fibers and fabrics of this invention are hydrophobic. Hydrophobicity can be measured using a number of tests, which are described in detail below. One method of determining hydrophobicity of a fiber is by hydrostatic head. Preferably, the hydrostatic head height is at least about 30 mm; more preferably at least about 62 mm; even more preferably at least about 125 mm; even more preferably at least about 150 mm; even more preferably at least about 181 mm; even more preferably at least about 195 mm; and most preferably at least about 210 mm.

When considering the hydrophobicity of a fiber, it is important to remember that the polyolefin fibers themselves are hydrophobic. Thus, when two fibers are compared the fiber with lower amount of finish will tend to have a higher hydrostatic head value. Accordingly, this invention is described with respect to fibers that are processable into nonwoven fabrics at certain throughputs so that it is clear that the fibers have sufficient levels of antistat to manufacture fabrics.

Fiber hydrophobicity is also measured by using ASTM D1117-79 "SINK TIME" method. When tested as described below, fibers are considered hydrophobic if they exhibit a sink time of preferably at least about 0.8 hour, more preferably at least about 4 hours, and most preferably at least about 20 hours.

In addition, hydrophobicity can be measured using a fabric runoff test. According to this test, hydrophobicity of a fabric is determined by runoff of a wetting fluid. Preferably, a fabric having the parameters described below has a percent runoff value at least about 79%, more preferably at least about 85%, and most preferably at least about 94.5%.

Fibers of the instant invention and fabrics made therefrom are particularly useful for making nonwoven coverstock found in personal hygiene articles such as diapers, sanitary napkins, tampons, underpads, and the like. In general, such articles must have a fluid-absorbent material, such as wood pulp, rayon, gauze, tissue or the like, and in some cases, synthetic hydrophilic material such as hydrophilic polyurethane foam. In the case of a diaper, sanitary napkin, underpad, or the like, the fluid-absorbent material is generally provided in the form of a thermally bonded pad of wood pulp, fiber and conjugate fiber, which may have a rectangular or somewhat oval shape.

A diaper or adult incontinence pad or the like, typically comprises a water impermeable backing layer and a nonwoven coverstock of fibers, with fluid-absorbent material in between. The fibers and fabrics of the instant invention are well suited for the backing layers or sheets, leg cuffs and/or waist bands of the diaper. Typically, a diaper is positioned on a wearer so the nonwoven coverstock, leg cuffs and/or waist band is in contact with the wearer thereby keeping the wearer's skin relatively dry while effectively containing fluid within the diaper.

EXAMPLES

The invention is further described with respect to the following examples, which are intended to be exemplary and not limiting.

Test Methods

The following procedures are used to test the products:

Hydrostatic Head

This modified "Suter" apparatus is an alternative method to A.A.T.C.C. 1952-18 British Standard 2823 apparatus. The hydrostatic pressure was applied to the top of 5 grams sample of hand carded staple fiber and was controlled by a rising water column at constant rate of 290 cc/minute. The area diameter of the exposed fiber was 3.7 cm. A mirror was fixed so that the under side of the fiber sample could be observed. The mirror was adjusted so that it was possible to see the bottom of the multiple hole cap. The staple fiber holder was 3.7 cm inside diameter×3.0 cm long with a screen in the top and a cap with multiple holes to allow the water to flow through. The column height above the sample screen was 60 cm. The water was added to the column through a 0.5 cm diameter vertical hole 2.0 cm above the sample screen. A 0.5 cm diameter drain hole was placed 0.5 cm above the sample screen of the column to remove the water after each test.

The procedure was begun by plugging the column drain hole. Then, 5 grams (±0.10 g) of dry, hand carded staple fiber was obtained and placed in the sample holder of the column, and the cap was placed on the column. The fiber was compressed tightly in the sample holder. Water was pumped into the column at a rate of 290 cc/minute. Until the first drop of water was observed to fall, and the addition of water was immediately stopped and the water column height was measured in millimeters (mm). The column was opened and drained. The wet sample was removed and the chamber and mirror were thoroughly dried. This procedure was repeated for a total of five results per fiber sample and results were reported as the average value in millimeters of rising water.

Sink Time

Sink time was used to characterize the degree of wetting of fibers by determining the time as measured in seconds for 5 grams of staple sample loosely packed into a 3 gram mesh basket to sink below the surface of water following ASTM METHOD D-1117-79.

Fabric Runoff

A nonwoven fabric of about 19 to 20 grams/square yard and 15% bond area was produced by carding and calender bonding using a diamond calender roll (smooth bottom roll) at line speeds of 250 and 500 feet/minute and at a temperature of 166° C. (Two cards were used.)

An 11 inch (machine direction)×5 inch (cross machine direction) sample of calendered fabric with rough face up was placed over 2 sheets of filter paper 5 inches (12.7 cm)×10.75 inches (ca. 27.3 cm) long. The fabric and 2 sheets of paper were placed on a board with an incline of 10 degrees. The sample was oriented with the longer side in the direction of the incline. The tip of a separator funnel was placed one inch from the top of the fabric and one inch above the fabric at the center of the sample. Across and ¼ inch (6.35 mm) from the bottom of the sample was placed a paper towel of a known weight. The separator funnel was filled with 25 ml of Syn-urine (Jayco Pharmaceuticals, Camp Hill, Pa.) as wetting fluid. The stopcock of the funnel was opened and the runoff on the weighted paper towel was collected and weighed to the nearest 0.1 gram. The procedure was repeated for a total of five times and reported as the average liquid runoff from the fabric as percent runoff. The higher the percent runoff value the greater the fabric hydrophobicity.

Breaking Strength and Elongation

Breaking strength (load) and elongation were measured using ASTM D1117-80 (Supplement to Breaking and Load Elongation of Textile Fabrics - ASTM-1682) and were calculated using the Instron (CRT - Constant Rate of Traverse Tensile Testing Machine) using the following speeds:

| | |
|---|---|
| Chart Speed | 2 inches/minute |
| Crosshead Speed | 5 inches/minute |
| Gauge Length | 5 inches |
| Extension Rate | 40%/minute |

The test specimens were 1 inch (25 mm) in width and 7 inches (180 mm) in length. Ten specimens were prepared with their long dimension parallel to the cross-machine direction. The results are reported as the average breaking load in grams/inch and the apparent elongation in percent.

Electrostatic Charge

Electrostatic charge was measured where the web leaves the card (comes off the doffer) using a Model FM300 Electrostatic Fieldmeter (Simco Company, Inc., Hatfield, Pa.). Electrostatic charge was measured by holding the fieldmeter approximately 8.75 centimeters (3.5 inches) from the web.

Example 1

Polypropylene in flake form (crystallinity 60%, Mw $3.5\times10^5$, molecular weight distribution 5.7, and melt flow 9.5 g/10 minutes) was mixed in an impact blender. After thorough blending, the mixture was fad into 1.5 inch (3.81 cm) extruder, spun through a 675 hole spinnerette at 290° C. at a melt flow rate of 34 and air quenched, thereby forming a multifilament fiber. The multifilament fiber was passed over a feed or kiss roll partly immersed in a tank era spin finish composition of an aqueous solution comprising 0.37% potassium octyl/decyl alkyl phosphate plus 0.13% of diethylene glycol (DEG), as a solubilizer, and 99.5% water. The contact between the fiber and the kiss roll was of sufficient duration and speed to apply about 0.1 weight percent of the finish, based on the weight of the dry fiber.

The multifilament fiber was stretched at a draw ratio of 1.25 at 110° C. to obtain 2.2 dpf round filaments. The resulting continuous filaments were crimped with steam at 100° C. An over finish was applied as a composition comprising 14.6% by weight of a potassium octyl/decyl alkyl phosphate, 5.4% by weight of diethylene glycol as a solubilizer, and 80% by weight of a 50% polydimethylsiloxane emulsion as a lubricant (Y-12411, formerly available as LE-458HS, Union Carbide Chemicals and Plastic Co., Inc., Tarrytown, N.Y.). The over finish was applied by spraying. After air drying, the 2.2 dpf fibers were cut to 1.5 inch length staple. The hydrophobicity of the staple fibers was tested by the Sink Time and Hydrostatic Head tests as described above.

A nonwoven fabric of 19–20 grams/square yard and 15% bond area was produced by carding and calender bonding using a diamond calender roll (smooth bottom roll) at line speeds of 250 and 500 feet/minute and at a temperature of 166° C. (Two carding steps were used.) The test nonwoven fabric was cut into strips for carrying out the Cross Directional Strength and Fabric Runoff tests described above.

Fibers and fabric hydrophobicity as well as tensile strengths were good. No calender roll deposit was observed. See Tables 1 and 2.

Example 2

Polypropylene staple fibers were processed as in Example 1 with the following differences. The spin finish composition was an aqueous solution comprising an antistat of 0.37% potassium $C_{12}$ alkyl phosphate plus 0.13% diethylene glycol, as a solubilizer, and 99.5% water. The over finish was another non-depositing antistat composition comprising 14.6% by weight of potassium $C_{12}$ alkyl phosphate plus 5.4% diethylene glycol, as a solubilizer, and 80% by weight of a 50% polydimethylsiloxane emulsion as a lubricant (Y-12411).

The fiber and fabrics made therefrom gave good hydrophobicity and tensile properties without calender roll deposits. See Tables 1 and 2.

Example 3

Polypropylene staple fibers were processed as in Example 1 with the following differences. The spin finish composition was an aqueous solution comprising 0.5% by weight of an antistat of sodium oleyl (EO) phosphate (Protolube 5865, National Starch and Chemical Corporation, Bridgewater, N.J.) and 99.5% by weight of water. No solubilizer was required with sodium oleyl (EO) phosphate as the antistat in the non-depositing antistat composition.

The over finish was another non-depositing antistat composition comprising 40% by weight of an antistat of sodium oleyl (EO) phosphate (Protolube 5865) and 60% by weight of a 50% polydimethylsiloxane emulsion as a lubricant (Y-12411).

The fiber had good hydrophobicity and tensile strength without forming calender roll deposits. See Tables 1 and 2.

Example 4

Polypropylene fibers were processed as in Example 1 with the following differences. The spin finish used was an aqueous solution containing 0.37% by weight of potassium $C_6$ alkyl phosphate and 0.13% by weight diethylene glycol. The over finish comprised 14.6 parts by weight potassium $C_6$ alkyl phosphate, 5.4 parts by weight diethylene glycol, and 80 parts by weight of polydimethylsiloxane (from Y-12411). The over finish was applied as a 20 weight % aqueous solution. The sample had good hydrophobicity and did not form deposits. See Tables 1 and 2.

Example 5

Polypropylene staple fibers were processed as in Example 1 with the following differences. The spin finish contained 4.25% by weight of potassium $C_8/C_{10}$ alkyl phosphate, 0.75% by weight of diethylene glycol, and 95% by weight water.

The over finish comprised 50% by weight of the mixture used in the spin finish and 50% by weight polydimethylsiloxane as a lubricant (from Y-12411). The over finish was applied to the crimped fiber at 20 weight % aqueous solution. See Tables 3 and 4.

Example 6

Polypropylene staple fibers were processed as in Example 1 with the following differences. The spin finish comprised 47% by weight of a potassium octyl/decyl alkyl phosphate as an antistat 20% by weight of sodium oleyl (EO) phosphate as a solubilizer (Protolube 5865), and 33% by weight of polydimethylsiloxane (from Y-12411). The spin finish was applied as a 5% aqueous solution.

The over finish comprised 35% by weight of a potassium octyl/decyl alkyl phosphate as an antistat, 15% by weight of sodium oleyl (EO) phosphate as a solubilizer (Protolube 5865), and 50% by weight polydimethylsiloxane (from Y-12411). The over finish was applied as a 15% aqueous solution.

The sample had good hydrophobicity and tensile strength and did not form deposits. See Tables 3 and 4.

Example 7

Polypropylene staple fibers were processed as in Example 1 with the following differences. The spin finish contained 33% by weight of potassium $C_8/C_{10}$ alkyl phosphate, 14% by weight of diethylene glycol, 20% by weight of polyethylene glycol (PEG-400) as a solubilizer and 33% by weight of polydimethylsiloxane (from Y-12411). The spin finish was applied as a 5% aqueous solution.

The over finish comprised 35% by weight of potassium $C_8/C_{10}$ alkyl phosphate, 15% by weight of polyethylene glycol (PEG-400) as a solubilizer, and 50% by weight of polydimethylsiloxane emulsion as a lubricant (from Lurol 4462, George A. Goulston Co. Inc., Monroe, N.C.). The over finish was applied as a 15% aqueous solution.

The sample had good fiber hydrophobicity and tensile strength without deposit. See Tables 3 and 4.

Comparative Example 1

Polypropylene staple fibers were processed as in Example 1 with the following differences. The spin finish contained 5.5% by weight of potassium butyl phosphate (from Lurol AS-Y, George A. Goulston Co. Inc., Monroe, N.C.) as an antistat, 4.2% by weight of polydimethylsiloxane (from Y-12411) as a lubricant and 90.3% by weight water. No solubilizer was used.

The over finish contained 1 part by weight potassium butyl phosphate (from Lurol AS-Y) and 1 part by weight of polydimethylsiloxane (from Y-12411). The over finish was applied as a 15 weight % aqueous solution.

Results are shown in Tables 3 and 4.

Example 8

Polypropylene staple fibers were processed to show the affect of using greater amounts of finish.

Polypropylene staple fibers were processed as in Example 1 with the following differences. The spin finish and over finish used contained a 7:3 weight ratio of potassium $C_8/C_{10}$ alkyl phosphate and diethylene glycol. The spin finish was a 5% aqueous solution of the antistatic composition. The over finish was made with the antistatic composition and polydimethylsiloxane (Y-12411) as a 25% aqueous solution containing a 1:1 ratio of antistatic composition to lubricant.

No roll deposits were detected on the calender rolls after six hours of processing the staple fibers into nonwoven fabric. See Tables 5 and 6.

Example 9

Polypropylene staple fibers were processed to show the affects of greater amounts of finish.

Polypropylene staple fibers were processed as in Example 6 except the spin finish was 5% solution and over finish was 25% solution.

No roll deposits were detected on the calender rolls after six hours of running time of processing the staple fibers into nonwoven fabric. See Tables 5 and 6.

Example 10

Polypropylene staple fibers were processed to show the affects of larger amounts of finish.

Polypropylene staple fibers were processed as in Example 7 except the spin finish contained a mixture of 70% by weight of potassium $C_8/C_{10}$ alkyl phosphate and 30% by weight of diethylene glycol. The spin finish was a 5% aqueous solution and the over finish was a 25% aqueous solution.

No roll deposits were detected on the calender rolls after six hours of processing the staple fibers into nonwoven fabric. See Tables 5 and 6.

Examples 8–10 show that use of high levels of the finish of this invention does not cause formation of solid antistatic build-up on the calender roll.

Comparative Example 2

Polypropylene staple fibers were processed in the same manner as in Example 1 except as follows. The spin finish was a solution containing 96.5 weight % water and 3.5 weight % of a mixture having 33% by weight of potassium butyl phosphate as an antistat (from Lurol AS-Y) and 67% by weight of polydimethylsiloxane emulsion as a lubricant (from Y-12411).

The over finish was a solution containing 50% by weight of potassium butyl phosphate as an antistat (from Lurol AS-Y) and 50% by weight of water.

Roll deposits were detected on the calender rolls within one hour of processing the staple fibers into nonwoven fabric. See Tables 5 and 6.

Examples 11–14

Polypropylene staple fibers were processed as in Example 1 with the following differences. The over finish was a 1:1 by weight ratio mixture of 25 weight % potassium butyl phosphate (from Lurol AS-Y), 18.5 weight % potassium $C_8/C_{10}$ alkyl phosphate, and 6.5 weight % diethylene glycol (DEG) and 50 weight % water. The overfinish was applied at varying rates. The results are shown in Table 7 and 8.

Example 15

The hydrostatic head of polypropylene fiber was measured using the yarn of Example 1 without over finish. The yarn had a melt flow rate of 17 and was 2.5 dpf. It was crimped (28 crimps per inch) and cut to form 1½ inch staple fibers of 2.2 dpf. It was washed with hot water three times to remove the spin finish and was dried before testing. The fiber had a hydrostatic head value of 273 mm.

Comparative Example 3

The hydrostatic head of polypropylene fiber was measured using T-190™ polypropylene staple fiber (Hercules Incorporated, Wilmington, Del.). The finish was washed from the fiber. The fiber had a hydrostatic head value of 256 mm.

TABLE 1

FIBER AND FABRIC HYDROPHOBICITY PROPERTIES

| | Spin Fin.[1] | | | Solubilizer | Card | Fiber | Fabric | Fiber | | Static |
|---|---|---|---|---|---|---|---|---|---|---|
| | % Antistat (By weight) | % Silicone (By weight) | Total Fin.[2] (By weight) | % Type (By weight[3]) | Speed Ft./Min. | W.H.C. (mm) | Runoff (%) | Sink Time (Hrs.) | Roll Deposit[4] | Reading (Volts) |
| Ex. 1 | 0.10 | 0.0 | 0.39 | 27 DEG | 250<br>500 | 275 | 98.0 | >20 | None | 1,280<br>840 |
| Ex. 2 | 0.18 | 0.0 | 0.29 | 27 DEG | 250<br>500 | 181 | 95.0<br>97.0 | >20 | None | 490<br>390 |
| Ex. 3 | 0 14 | 0.0 | 0.33 | None | 250<br>500 | 132 | 95.0 | >20 | None | 380<br>170 |
| Ex. 4 | 0.14 | 0.0 | 0.26 | 27 DEG | 250<br>500 | 163 | 96 | >20 | None | 30<br>20 |

[1]Amount on finish on spin yarn.
[2]Amount of finish on staple fibers.
[3]Percent of solubilizer in the antistatic composition of the finish on the dry staple fiber.
[4]No observable calender roll deposits after 2 hours running time.

TABLE 2

FIBER PHYSICAL PROPERTIES

| | SPIN YARN[1] | | | | STAPLE FIBER[2] | | | |
|---|---|---|---|---|---|---|---|---|
| | DPF[3] | MFR[4] | Tenacity[5] | % Elongation[6] | CPI[7] | DPF[5] | Tenacity[6] | Elongation[10] |
| Ex. 1 | 2.5 | 17 | 2.1 | 373 | 28 | 2.2 | 2.2 | 281 |
| Ex. 2 | 2.6 | 40 | 1.6 | 590 | 29 | 2.3 | 1.8 | 415 |
| Ex. 3 | 2.5 | 49 | 1.6 | 538 | 29 | 2.3 | 1.7 | 359 |
| Ex. 4 | 2.5 | 50 | 1.5 | 577 | 26 | 2.2 | 1.8 | 393 |

[1]Properties of fibers immediately after spinning.
[2]Properties of crimped and cut staple fibers of 1.5 inch length.
[3]Fiber size in denier per filament.

TABLE 2-continued

| FIBER PHYSICAL PROPERTIES | | | | | | | |
|---|---|---|---|---|---|---|---|
| SPIN YARN[1] | | | | STAPLE FIBER[2] | | | |
| DPF[3] | MFR[4] | Tenacity[5] | % Elongation[6] | CPI[7] | DPF[5] | Tenacity[6] | Elongation[10] |

[4]Melt flow rate of the polypropylene fiber.
[5]Tenacity measured according to ASTM D-117-80 (dry method).
[6]Elongation measured as described above.
[7]Crimps per inch (ASTM Method D3937-90).
[8]Staple fiber size in denier per filament.

TABLE 3

| | FIBER AND FABRIC HYDROPHOBICITY PROPERTIES | | | | | | | | | | |
|---|---|---|---|---|---|---|---|---|---|---|---|
| | Spin Fin.[1] | | | | | | | | | | |
| | % Antistat (By weight) | % Silicone (By weight) | Total Fin.[2] (By weight) | Solubilizer % Type (By weight[3]) | Card Speed Ft./Min. | Fiber W.H.C. (mm) | Fabric Runoff (%) | Fiber Sink Time (Hrs.) | Roll Deposit[4] | Static Tensile Reading (Volts) | Fabric CD Strength (g/inch) |
| Ex. 5 | 0.083 | 0.167 | 0.30 | 15 DEG | 250 | 195 | 97.5 | >20 | None | 1,500 | 487 |
| Ex. 6 | 0.070 | 0.14 | 0.30 | 15 Na Oleyl (EO) Phosphate | 250 | 200 | 97.8 | >20 | None | 3,160 | 561 |
| Ex. 7 | 0.080 | 0.16 | 0.30 | 15 PEG 400 | 250 | 195 | 97.6 | >20 | None | 800 | 552 |
| Comparative Ex. 1 | 0.073 | 0.147 | 0.34 | None | 250 | 195 | 97.1 | >20 | — | 1,870 | 480 |

[1]Amount on finish on spin yarn.
[2]Amount of finish on staple fibers.
[3]Percent of solubilizer in the antistatic composition of the finish on the dry staple fiber.
[4]No observable calender roll deposit after 2 hours running time.

TABLE 4

| | FIBER PHYSICAL PROPERTIES | | | | | | | |
|---|---|---|---|---|---|---|---|---|
| | SPIN YARN[1] | | | | STAPLE FIBER[2] | | | |
| | DPF[3] | MFR[4] | Tenacity[5] | Elongation[6] | CPI[7] | DPF[8] | Tenacity[5] | Elongation[6] |
| Ex. 5 | 2.46 | 40.0 | 1.66 | 597.17 | 41.0 | 2.30 | 1.70 | 396.43 |
| Ex. 6 | 2.45 | 38.0 | 1.55 | 535.68 | 36.7 | 2.40 | 1.71 | 396.55 |
| Ex. 7 | 2.40 | 40.0 | 1.77 | 600.00 | 35.6 | 2.36 | 1.61 | 355.73 |
| Comparative Ex. 1 | 2.40 | 37.6 | 1.80 | 600.00 | 38.5 | 2.25 | 1.76 | 368.23 |

[1]Properties of fibers immediately after spinning.
[2]Properties of crimped and cut staple fibers of 1.5 inch length.
[3]Fiber size in denier per filament.
[4]Melt flow rate of the polypropylene fiber.
[5]Tenacity measured according to ASTM D-117-80 (dry method).
[6]Elongation measured as described above.
[7]Crimps per inch (ASTM Method D3937-90).
[8]Staple fiber size in denier per filament.

TABLE 5

FIBER AND FABRIC HYDROPHOBICITY PROPERTIES

| | Spin Fin.[1] | | | | | | | | | | Fabric |
|---|---|---|---|---|---|---|---|---|---|---|---|
| | % Antistat (By weight) | % Silicone (By weight) | Total Fin.[2] (By weight) | Solubilizer % Type (By weight[3]) | Card Speed Ft/Min. | Fiber W.H.C. (mm) | Fabric Runoff (%) | Fiber Sink Time (Hrs.) | Roll Deposit[4] | Static Reading (Volts) | tensile CD Strength (g/inch) |
| Ex. 8 | 0.20 | 0.0 | 0.53 | 30 DEG | 250 | 64.0 | 79.0 | 0.80 | None | 20 | 628 |
| Ex. 9 | 0.11 | 0.08 | 0.64 | 30 Na Oleyl (EO) Phosphate | 250 | 62.0 | 85.0 | >4 | None | 20 | 528 |
| Ex. 10 | 0.07 | 0.15 | 0.49 | 30 PEG 400 | 250 | 102.3 | 94.5 | >4 | None | 10 | 411 |
| Comparative Ex. 2 | 0.09 | 0.18 | 0.25 | — | 250 | 180.0 | 98.0 | >20 | Yes Within 1 hour | 100 to 4,000 | 500 |

[1]Amount on finish on spin yarn.
[2]Amount of finish on staple fibers.
[3]Percent of solubilizer in the antistatic composition of the finish on the dry staple fiber.
[4]No roll deposits detected on calender roll after 6 hours running time.

TABLE 6

FIBER PHYSICAL PROPERTIES

| | SPIN YARN[1] | | | | STAPLE FIBER[2] | | | |
|---|---|---|---|---|---|---|---|---|
| | DPF[3] | MFR[4] | Tenacity[5] | Elongation[6] | CPI[7] | DPF[8] | Tenacity[5] | Elongation[6] |
| Ex. 8 | 2.56 | 36.0 | 1.55 | 529.07 | 28.0 | 2.31 | 1.65 | 387.35 |
| Ex. 9 | 2.46 | 32.6 | 1.53 | 518.41 | 29.0 | 2.40 | 1.65 | 419.43 |
| Ex. 10 | 2.56 | 36.7 | 1.55 | 571.92 | 30.0 | 2.29 | 1.59 | 399.22 |
| Comparative Ex. 2 | 3.10 | 28.0 | — | — | 23.2 | 2.20 | 2.35 | 333.00 |

[1]Properties of fibers immediately after spinning.
[2]Properties of crimped and cut staple fibers of 1.5 inch length.
[3]Fiber size in denier per filament.
[4]Melt flow rate of the polypropylene fiber.
[5]Tenacity measured according to ASTM D-117-80 (dry method).
[6]Elongation measured as described above.
[7]Crimps per inch (ASTM Method D3937-90).
[8]Staple fiber size in denier per filament.

TABLE 7

FIBER HYDROPHOBICITY PROPERTIES

| Sample | Total finish (%)[1] | Rising Water Column Staple | Static Reading (Volts) | Roll Deposit |
|---|---|---|---|---|
| Ex. 11 | 0.15 | 210 | 170 | —[2] |
| Ex. 12 | 0.23 | 178 | 90 | —[2] |
| Ex. 13 | 0.28 | 129 | 30 | —[2] |
| Ex. 14 | 0.51 | 98 | 93 | none[3] |

TABLE 7-continued

FIBER HYDROPHOBICITY PROPERTIES

| Sample | Total finish (%)[1] | Rising Water Column Staple | Static Reading (Volts) | Roll Deposit |
|---|---|---|---|---|

[1]Over finish by dry weight of fiber.
[2]Insufficient amounts produced to test for two or more hours. No observable deposits during processing.
[3]No deposit observed on the calender roll after six hours at 121 feet/minute.

TABLE 8

FIBER PHYSICAL PROPERTIES

| | SPIN YARN[1] | | | | STAPLE FIBER[2] | | | |
|---|---|---|---|---|---|---|---|---|
| | DPF[3] | MFR[4] | Tenacity[5] | Elongation[6] | CPI[7] | DPF[8] | Tenacity[5] | Elongation[6] |
| Ex. 11 | 3.36 | 32.6 | 1.57 | 557.67 | 19.5 | 2.35 | 2.24 | 358 |
| Ex. 12 | 3.36 | 32.6 | 1.57 | 557.67 | 19.5 | 2.35 | 2.24 | 358 |
| Ex. 13 | 3.36 | 32.6 | 1.57 | 557.67 | 19.5 | 2.35 | 2.24 | 358 |

TABLE 8-continued

| | FIBER PHYSICAL PROPERTIES | | | | | | | |
|---|---|---|---|---|---|---|---|---|
| | SPIN YARN[1] | | | | STAPLE FIBER[2] | | | |
| | DPF[3] | MFR[4] | Tenacity[5] | Elongation[6] | CPI[7] | DPF[8] | Tenacity[5] | Elongation[6] |
| Ex. 14 | 3.36 | 32 | 1.50 | 557 | 32 | 2.9 | 1.77 | 412 |

[1]Properties of fibers immediately after spinning.
[2]Properties of crimped and cut staple fibers of 1.5 inch length.
[3]Fiber size in denier per filament.
[4]Melt flow rate of the polypropylene fiber.
[5]Tenacity measured according to ASTM D-117-80 (dry method).
[6]Elongation measured as described above.
[7]Crimps per inch (ASTM Method D3937-90).
[8]Staple fiber size in denier per filament.

Other embodiments of the invention will be apparent to those skilled in the art from consideration of this specification or practice of the invention disclosed herein. It is intended that the specification and examples be considered as exemplary only, with the true scope and spirit of the invention being indicated by the following claims.

What is claimed is:

1. A process of preparing a fabric comprising providing polyolefin staple fibers having a finish which comprises an antistatic composition, wherein the staple fiber with the finish has a hydrostatic head value of at least about 102 mm, and carding and bonding the fibers to form a fabric at a throughput of at least about 128 pounds/hour for a period of at least two hours without formation of significant solid antistatic composition build-up on the nonwoven fabric processing equipment.

2. A process as claimed in claim 1, wherein the fabric is a nonwoven fabric, and the fibers are 1–6 dpf staple fibers having a length of about 1 to 3 inches.

3. A process as claimed in claim 1, wherein the bonding comprises thermal bonding.

4. A process as claimed in claim 2, wherein the fibers comprise 0.1 to 1%, by dry weight of the fiber, finish and the fabric has a percent runoff value at least about 79%.

5. A process as claimed in claim 4, wherein the fabric has a percent runoff value at least about 85%.

6. A process as claimed in claim 4, wherein the fabric has a percent runoff value of at least about 94.5%.

7. A process as claimed in claim 1 wherein the fibers are polypropylene fibers.

8. A process as claimed in claim 2 wherein the fabric is a nonwoven fabric having a basis weight of about 10 to 60 grams/square yard and a cross directional strength of at least about 150 grams/inch, and the bonding comprises thermally bonding using a calender roll with a thermal bond area of at least about 10%.

9. A process as claimed in claim 4 wherein the fabric has a basis weight of about 10–30 grams/square yard and a cross directional strength of at least about 250 grams/inch, the bonding comprises thermally bonding using a calender roll with a thermal bond area of about 15–40%, and the fibers comprise polypropylene fibers.

10. A process as claimed in claim 9 wherein the fabric has a basis weight of about 15–25 grams/square yard and a cross directional strength of at least about 350 grams/inch, and is prepared by carding and thermally bonding using a calender roll with a thermal bond area of about 15–20%.

11. A process as claimed in claim 10 wherein the basis weight is about 19 to 20 grams/square yard.

12. A process as claimed in claim 1, wherein the finish further comprises a lubricant.

13. A process as claimed in claim 9, wherein the fabric has a percent runoff value at least about 85%.

14. A process as claimed in claim 9, wherein the fabric has a percent runoff value at least about 94.5%.

15. A process as claimed in claim 1 wherein the throughput is at least about 179 pounds/hour.

16. A process as claimed in claim 1 wherein the throughput is at least about 1,000 pounds/hour.

17. A process as claimed in claim 1 wherein the throughput is at least about 1,500 pounds/hour.

18. A process as claimed in claim 1 wherein the bonding the fabric comprises thermally bonding with a calender roll and no solid antistatic composition build-up visible to the naked eye forms on the calender roll.

19. A process as claimed in claim 1 wherein bonding the fabric is selected from the group consisting of calender roll, hot air, sonic or laser bonding.

20. A process as claimed in claim 1, wherein the electrostatic charge is less than about 4000 volts during processing.

21. A process as claimed in claim 1, wherein the electrostatic charge is less than about 2000 volts during processing.

22. A process as claimed in claim 1, wherein the electrostatic charge is less than about 1000 volts during processing.

23. A process as claimed in claim 1, wherein the electrostatic charge is less than about 500 volts during processing.

24. A process as claimed in claim 1 wherein the fabric is a nonwoven fabric having a basis weight of about 10–60 grams/square yard that has a cross directional strength of at least about 150 grams/inch and the bonding comprises thermally bonding using a calender roll with a thermal bond area of at least about 10%.

25. A process as claimed in claim 1 wherein the fabric is a nonwoven fabric having a basis weight of about 10–30 grams/square yard that has a cross directional strength of at least about 250 grams/inch and the bonding comprises thermally bonding using a calender roll with a thermal bond area of about 15–40%.

26. A process as claimed in claim 1 wherein the fabric is a nonwoven fabric having a basis weight of about 15–25 grams/square yard that has a cross directional strength of at least about 350 grams/inch and the bonding comprises thermally bonding using a calender roll with a thermal bond area of about 15–20%.

27. A process as claimed in claim 1 wherein the period is at least about six hours.

28. A process as claimed in claim 1 wherein the period is at least about one week.

29. A process as claimed in claim 1 wherein the polyolefin fibers comprise polypropylene.

30. A process as claimed in claim 29 wherein the polyolefin fibers comprise polypropylene homopolymer.

31. A process as claimed in claim 29, wherein the polyolefin fibers comprise polypropylene copolymer comprising at least 90 weight % polypropylene and up to 10 weight % ethylene, butene or mixtures thereof.

32. A process as claimed in claim 1 wherein the polyolefin fibers comprise 1.8 to 3 dpf, about 1¼ to 2 inch staple polypropylene monofilament fibers comprising about 0.15 to 0.3%, by dry weight of the fiber, of the finish, the finish further comprises a lubricant, the fabric is a nonwoven fabric having a basis weight of about 19 to 20 grams/square yard and has a cross directional strength of at least about 350 grams/inch, the bonding comprise thermally bonding using a calender roll with a thermal bond area of about 15–20%, the throughput is at least about 1,000 pounds/hour, the processing is carried out for at least about one week with no solid antistatic composition build-up visible to the naked eye forming on the calender roll, the electrostatic charge is less than about 2000 volts during processing, the fibers having the finish have a sink time of at least about 4 hours, and the nonwoven fabric has a percent runoff value at least about 79%.

33. A process as claimed in claim 1 wherein the fibers comprise monofilament fibers.

34. A process as claimed in claim 1 wherein the fibers comprise bicomponent fibers having a polypropylene core layer and a polyethylene outer layer.

35. A process as claimed in claim 1 wherein the finish further comprises a lubricant.

36. A process as claimed in claim 35 wherein the lubricant is selected from the group consisting of mineral oils, paraffinic waxes, polyglycols and silicones.

37. A process as claimed in claim 35 wherein the lubricant comprises a polydimethylsiloxane.

38. A process as claimed in claim 1 wherein the fibers comprise about 0.1 to 1%, by dry weight of the fiber, of the finish.

39. A process as claimed in claim 1 wherein the fibers comprise about 0.15 to 0.5%, by dry weight of the fiber, of the finish.

40. A process as claimed in claim 1 wherein the fibers comprise about 0.15 to 0.3%, by dry weight of the fiber, of the finish.

41. A process as claimed in claim 1 wherein the polyolefin fibers comprise about 1.8 to 3 dpf, about 1 to 3 inch staple polypropylene monofilament fibers having about 0 to 1%, by dry weight of the fiber, of the finish; the finish further comprises a lubricant; the fabric is a nonwoven fabric having a basis weight of about 15–25 grams/square yard that has a cross directional strength of at least about 350 grams/inch; the bonding comprises thermally bonding using a calender roll with a thermal bond area of about 15–20%; the throughput is at least about 1,000 pounds/hour; and the process is carried out for at least about six hours with no solid antistatic composition build-up visible to the naked eye forming on the calender roll.

42. A process as claimed in claim 1, wherein the finish comprises an antistatic composition selected from the group consisting of composition (I) which comprises:

(a) at least one neutralized $C_3$–$C_{12}$ alkyl or alkenyl phosphate alkali metal or alkali earth metal salt; and (b) a solubilizer comprising at least one member selected from the group consisting of glycols, polyglycols, glycol ethers, and neutralized phosphoric ester salts having the general formula:

$$(MO)_x-\overset{\overset{\displaystyle O}{\|}}{P}\leftarrow O(R_1)_nR)_y \qquad (2)$$

wherein M, which may be the same or different, is an alkali or alkali earth metal or hydrogen, R is a $C_{16}$–$C_{22}$ alkyl or alkenyl group, $R_1$ is ethylene oxide or propylene oxide, and n is 1 to 10, x is 1 to 2 and y is 2 to 1, and x+y=3, and composition (II) which comprises at least one neutralized phosphoric ester salt having the general formula (2).

43. A process as claimed in claim 42 wherein the finish comprises 20:1 to 0.5:1 by weight of the antistat composition to the solubilizer.

44. A process as claimed in claim 43 wherein the finish further comprises a lubricant and the ratio of antistatic composition to the lubricant is about 5:1 to 1:5 by weight.

45. A process of preparing a fabric comprising providing polyolefin staple fibers having a finish comprising an antistatic composition which comprises:

(a) at least one neutralized $C_3$–$C_{12}$ alkyl or alkenyl phosphate alkali metal or alkali earth metal salt; and (b) a solubilizer, wherein the fiber having the finish is hydrophobic, and carding and bonding the staple fibers to form a nonwoven fabric.

46. A process as claimed in claim 45 wherein neutralized $C_3$–$C_{12}$ alkyl or alkenyl phosphate alkali metal or alkali earth metal salt the neutralized phosphate salt has a pH of about 5 to 9.

47. A process as claimed in claim 46 wherein neutralized $C_3$–$C_{12}$ alkyl or alkenyl phosphate alkali metal or alkali earth metal salt has a pH of about 5 to 7.

48. A process as claimed in claim 45 wherein the alkyl or alkenyl group is a $C_6$–$C_{12}$ alkyl group.

49. A process as claimed in claim 45 wherein the alkyl or alkenyl group is a $C_8$–$C_{12}$ alkyl group.

50. A process as claimed in claim 48 wherein the neutralized alkyl phosphate salt is an alkali metal salt.

51. A process as claimed in claim 45 wherein the neutralized alkyl phosphate salt is an alkali metal salt selected from the group consisting of sodium and potassium salts.

52. A process as claimed in claim 51 wherein the alkali metal salt is a potassium salt.

53. A process as claimed in claim 45 wherein the solubilizer comprises at least one member selected from the group consisting of glycols, polyglycols, glycol ethers, and neutralized phosphoric ester salts having the general formula:

$$(MO)_x-\overset{\overset{\displaystyle O}{\|}}{P}\leftarrow O(R_1)_nR)_y \qquad (2)$$

wherein M, which may be the same or different, is an alkali or alkali earth metal or hydrogen, R is a $C_{16}$–$C_{22}$ alkyl or alkenyl group, $R_1$ is ethylene oxide or propylene oxide, and n is 1 to 10, x is 1 to 2, y is 2-1, and x+y=3.

54. A process as claimed in claim 45 wherein the solubilizer comprises at least one compound selected from the group consisting of glycols and polyglycols.

55. A process as claimed in claim 45 wherein the solubilizer comprises at least one compound selected from the group consisting of diethylene glycol or polyethylene glycol.

56. A process as claimed in claim 53 wherein the solubilizer comprises the neutralized phosphoric ester salt.

57. A process as claimed in claim 48 wherein the solubilizer comprises at least one member selected from the group consisting of glycols, polyglycols, and potassium or sodium oleyl (EO) phosphate having an ethylene content range of 2 to 9 moles.

58. A process as claimed in claim 45 wherein the fibers comprise polypropylene fibers.

59. A process as claimed claim 58 wherein the fibers are 1 to 6 dpf fibers cut into staple monofilament fibers having a length of about 1 to 3 inches.

60. A process as claimed in claims 45, further comprising a lubricant.

61. A process as claimed in claim 57 wherein the lubricant comprises at least one member selected from the group consisting of mineral oils, paraffinic waxes, polyglycols and silicones.

62. A process as claimed in claims 60, the finish further comprising a lubricant comprising at least one member selected from the group consisting of mineral oils, paraffinic waxes, polyglycols and silicones.

63. A process of preparing a fabric comprising providing polyolefin fibers having an antistatic finish which comprises at least one neutralized phosphoric ester salt having the general formula:

$$(MO)_x-\overset{\overset{\displaystyle O}{\|}}{P}\leftarrow O(R_1)_nR)_y \qquad (2)$$

wherein M, which may be the same or different, is an alkali or alkali earth metal or hydrogen, R is a $C_{16}$–$C_{22}$ alkyl or alkenyl group, $R_1$ is ethylene oxide or propylene oxide, and n is 1 to 10, x is 1 to 2 and y is 2 to 1, and x+y=3, and carding and bonding the fibers to form a nonwoven fabric.

64. A process as claimed in claim 63 wherein the neutralized phosphoric ester salt has a pH of about 5 to 9.

65. A process as claimed in claim 64 wherein the pH is about 5 to 7.

66. A process as claimed in claim 63 wherein the neutralized phosphoric ester salt is an alkali metal salt of oleyl ethylene oxide phosphate and n is 2–9.

67. A process as claimed in claim 63 wherein the neutralized phosphoric ester salt is a sodium oleyl (EO) phosphate having an ethylene content range of 2 to 9 moles.

68. A process as claimed in claims 63, further comprising a lubricant.

69. A process as claimed in claim 63 wherein the fibers comprise polypropylene.

70. A process as claimed in claim 66 wherein the fibers comprise polypropylene monofilament fibers.

71. A process as claimed in claim 69 wherein the fibers are 1 to 6 dpf fibers comprising 0.1 to 1%, based on the dry weight of the fibers, of finish; the fibers having the finish have a hydrostatic head value at least about 62 mm, and are cut into staple fibers having a length of about 1–3 inches; the fabric has a basis weight of about 10–60 grams/square yard and a cross directional strength of at least about 150 grams/inch; and the bonding comprises thermally bonding using a calender roll with a thermal bond area of at least about 10%.

72. A process as claimed in claim 63 comprising about 0.1 to 5%, by dry weight of the fiber, of finish.

73. A process of preparing a nonwoven fabric comprising providing non-depositing, hydrophobic, polyolefin staple fibers treated with an antistatic composition comprising:

(A) an antistat selected from the group consisting of alkali metal $C_8$ to $C_{12}$ alkyl phosphates and sodium oleyl (EO) phosphate; and (B) a solubilizer selected from the group consisting of glycols, polyglycols, glycol ethers, and potassium or sodium oleyl (EO) phosphate with an ethylene oxide content range of 2 to 9 moles, provided that when the antistatic is sodium oleyl (EO) phosphate, the solubilizer may be omitted, and carding and bonding the staple fibers to form the nonwoven fabric.

74. A process as defined in claim 73, the fabric characterized by runoffs greater than 90% and cross directional tensile strengths of at least 500 grams/inch.

75. A process as defined in claim 73, wherein said alkali metal is sodium or potassium.

76. A process as defined in claim 73, wherein said alkali metal is potassium.

77. A process as defined in claim 76, wherein said polyolefin is polypropylene.

78. A process as defined in claim 77, wherein said antistat is potassium $C_8/C_{10}$ alkyl phosphate.

79. A process as defined in claim 77, wherein said solubilizer is selected from the group consisting of diethylene glycol, polyethylene glycol, and sodium oleyl (EO)9 phosphate.

80. A process as defined in claim 77, wherein said solubilizer is used in an amount of from 5 to 50% of the antistat.

81. A process as defined in claim 77, further comprising a silicone lubricant.

82. A process as defined in claim 77, wherein the silicone comprises polydimethylsiloxane.

83. A process as defined in claim 77, wherein said fiber is treated with from about 0.05% to about 0.30% of said antistatic based on the weight of the fiber.

* * * * *

UNITED STATES PATENT AND TRADEMARK OFFICE

CERTIFICATE OF CORRECTION

PATENT NO. : 5,540,953

DATED : July 30, 1996

INVENTOR(S) : James H. Harrington

It is certified that error appears in the above-indentified patent and that said Letters Patent is hereby corrected as shown below:

Column 16, Line 31 replace "era" with --of a--.

Column 19, first (1st) footnote of Table 1, replace "on" with --of--.

Column 21, first (1st) footnote of Table 3, replace "on" with --of--.

Column 23, first (1st) footnote of Table 5, replace "on" with --of--.

Claim 59, Column 29, line 5 before "claim 58" insert --in--.

Claim 60, Column 29, line 8 replace "claims" with --claim--.

Claim 62, Column 29, line 13 replace "claims" with --claim--.

Claim 68, Column 29, line 40 replace "claims" with --claim--.

Signed and Sealed this

Tenth Day of December, 1996

*Attest:*

Bruce Lehman

BRUCE LEHMAN

*Attesting Officer*

*Commissioner of Patents and Trademarks*